US005486392A

United States Patent [19]

Green

[11] Patent Number: 5,486,392

[45] Date of Patent: Jan. 23, 1996

[54] ROLL-UP FLOOR MAT

[75] Inventor: Edward J. Green, Eagan, Minn.

[73] Assignee: Reese Enterprises, Inc., Rosemount, Minn.

[21] Appl. No.: 270,480

[22] Filed: Jul. 5, 1994

[51] Int. Cl.[6] ..... B32B 3/10

[52] U.S. Cl. ..... 428/54; 428/58; 428/62; 15/217; 15/215; 52/177; 52/181

[58] Field of Search ..... 428/54, 53, 62, 428/58; 52/177, 181; 15/215, 217

[56] References Cited

U.S. PATENT DOCUMENTS

| | | | |
|---|---|---|---|
| 3,383,822 | 5/1968 | Viehmann et al. | 52/667 |
| 3,592,289 | 7/1971 | Aysta et al. | 181/30 |
| 3,783,471 | 1/1974 | McGeary et al. | 15/215 |
| 3,808,628 | 5/1974 | Betts | 15/215 |
| 4,029,834 | 6/1977 | Bartlett | 428/62 |
| 4,276,728 | 7/1981 | Balzer et al. | 52/177 |
| 4,381,324 | 4/1983 | Ellingson, Jr. | 428/58 |
| 4,568,587 | 2/1986 | Balzer | 428/52 |
| 4,590,110 | 5/1986 | Arens | 428/53 |
| 4,663,903 | 5/1987 | Ellingson, Jr. | 428/52 |
| 4,766,020 | 8/1988 | Ellingson, Jr. | 428/54 |
| 5,157,804 | 10/1992 | Williams | 15/161 |
| 5,190,799 | 3/1993 | Ellingson, III | 428/53 |

OTHER PUBLICATIONS

Reese Enterprises, Inc. "Reese™ Perfec Clean Floor Mats and Grates", No. 12690/REE Dec. (1992).

*Primary Examiner*—Alexander S. Thomas
*Attorney, Agent, or Firm*—Merchant, Gould, Smith, Edell, Welter & Schmidt

[57] ABSTRACT

A floor mat including a plurality of rigid, elongated rails interconnected by flexible coupling members is provided. Each of the rails include a base portion supporting a tread surface and a pair of parallel side members connected to the sides of the base portion. Each of the side members defines a passageway. The coupling members are flexible, resilient, and each including a web with longitudinal side margins. Each web has connected to each side margin an arrangement for engaging the passageway of a side member. When the floor mat is disposed on a flat, horizontal floor, the web is at bottommost position in the floor mat.

14 Claims, 4 Drawing Sheets

ROLL-UP FLOOR MAT

FIELD OF THE INVENTION

This invention relates to roll-up floor mats and methods of making such floor mats.

BACKGROUND OF THE INVENTION

Devices such as grilles, grates, grids, mats are often placed near entrances of buildings for removing foreign substances such as water, dirt, sand, and the like from the footwear (e.g., shoes, boots) of people. In many instances, such as for business establishments wherein aesthetic appeal is very important, the devices preferably are pleasant to look at.

Because of the accumulation of foreign substances such as dirt, sand, and water can quickly render such devices aesthetically very unattractive, floor mats that can be easily removed and cleaned are useful. Typically, floor mats are bulky. To facilitate cleaning, floor mats that can be rolled up into a bundle, for example, as disclosed in U.S. Pat. Nos. 4,568,587, (Balzer) and 4,029,834, (Bartlett) have been devised.

The more the reduction in size accomplishable in the rolled-up configuration, the more readily the floor mat can be transported for cleaning and maintenance. On the other hand, the more the floor mat can render foreign substances such as dirt and sand less noticeable, the longer the floor mat can remain aesthetically appealing and less cleaning is required.

Because the floor mat is trod on and therefore subject to wear and tear, simple construction and relatively inexpensive replacement parts will facilitate more regular and less costly maintenance to preserve the function and aesthetic appeal of the floor mat. There is a need for a floor mat that can be rolled up into a relatively small bundle, is of relatively simple construction that maintains aesthetic appeal for a longer period of time, and is capable of rendering foreign substances less noticeable.

SUMMARY OF THE INVENTION

The present invention provides a floor mat that is adapted to be rolled up, for example, to facilitate ease of transportation. The floor mat of the present invention meets the need for a floor mat that is aesthetically appealing and is inexpensive to maintain. The floor mat comprises a plurality of rigid, elongated rails interconnected by coupling members. Each of the rails includes a base portion supporting a tread surface and a pair of parallel side members connected to the lateral sides of the base portion. Each of the side members defines a passageway for receiving an arrangement of a coupling member. The coupling members are flexible, resilient, and elongated, each interconnecting a pair of rails in a parallel, spaced relationship. Each of the coupling members includes a web with longitudinal side margins. Each web has connected to each of its side margins an arrangement for engaging the passageway of a side member of a rail of the present invention. When the floor mat is disposed on a flat, horizontal floor, the web is at the bottommost position in the floor mat. As used herein, "bottommost position" refers to a floor-contacting position of a structure when the floor mat is disposed on a flat, horizontal floor, but that structure does not necessarily have to be the only structure having floor contacting position. The term "unitarily" refers to the condition wherein there is no identifiable boundary existing where two members connect, as in the case of two portions of a structure that is molded or extruded as a single unit. The term "inwardly" when applied to a part of a rail or coupling member refers to a direction toward a midline on the rail or coupling member. The term "outwardly" refers to a direction away from a midline of the rail or coupling member. The term "upwardly" refers to a upward direction away from the floor if the floor mat is deployed on a flat, horizontal floor. The term "downwardly" refers to a direction into the floor if the floor mat is deployed on a flat, horizontal floor.

In a preferred embodiment, the coupling member of the floor mat of the present invention can be generally U-shaped wherein the bottom part of the U-shaped structure contacts the floor to support (i.e. the weight of) the rail in contact therewith. The bottom portion of the U-shaped structure corresponds to the web of the coupling member.

The arrangement in the coupling member for engaging the passageway of a side member of a rail of the present invention can have upwardly-facing flanges for contacting a top wall of the side members so that rail is supported by the flanges in contact therewith. An arm extends upwardly from the bottom portion of the coupling member at each side margin to terminate at a flange. The flange is connected to the arm remote from the web and faces upwardly. Each flange is receivable by an enlarged portion of one of the passageways of the rail of the present invention and the corresponding arm is receivable by a corresponding outer portion of the passageway.

The coupling members of the present invention can be manufactured with relatively simple processes. Also, the present invention provides ease in engaging the coupling members to the rails. For example, if each coupling member has many projections that need to be slid past surfaces of a rail, the manipulation of the projections increases the complexity of the engaging process and therefore the labor cost. In the floor mat of the present invention, other than the webs of the coupling members, no additional cushioning members need to be provided for supporting the floor mat and therefore no additional elements need to be provided on the rails to secure the additional cushioning members. This further reduces manufacturing cost. Furthermore, the relative lack of complex structures in both the rails and the coupling members make cleaning the floor mat a less daunting and less unpleasant job. Because the coupling members of the present invention are relative inexpensive, ease to replace, and easy to clean, the floor mat can be regularly maintained relatively inexpensively to remain functional and aesthetic appealing.

Moreover, because the web is at the bottommost position in the floor mat. There is nothing, other the degree of flexibility of the web, to hinder the base portions of two adjacent rails interconnected by the coupling member to be brought close to each other. When the floor mat is rolled up by flexing the coupling members such that the flanges of a coupling member are spread apart to move the base portions of the pair of rails, the rails (i.e., base portions thereof) can be brought closer together than in the case where the web is intermediate the tread surface and the bottommost part of the rail. This enables the floor mat to be rolled up into a smaller bundle, which greatly facilitates ease of transportation and reduces the space needed for storing bulky floor mats.

Floor mats are made for the specific purpose of providing a tread surface so people can wipe foreign substances, such as sand, dirt, and the like, from their footwear, e.g., the soles of their shoes. The floor mat of the present invention has the advantage of making foreign substances that have fallen on the web of a coupling member between the side members of neighboring rails less visible (or noticeable). Because of the low position of the webs, more parts of the webs are shielded by the rails and less light reaches the webs than in cases where the webs are closer to the tread surface. For this reason, foreign substances that collects on top of the webs are not as readily seen as otherwise. This further reduces the need of frequent cleaning of the floor mat to improve the aesthetic appeal.

The present invention further provides a method for making a floor mat that is adapted to be rolled up. The method comprises providing a plurality of rigid, elongated rails and a plurality of flexible, resilient, elongated coupling members and interconnecting the rails with the coupling members. Each of the rails includes a base portion supporting a tread surface and a pair of parallel side members connected to the lateral sides of the base portion. Each of the side members defines a passageway having an enlarged, inner portion and an outer portion open at the side member such that the opening faces downwardly. The flexible, elongated coupling members each includes a web with longitudinal side margins. An arm extends upwardly from the web at each side margin and terminates at an upwardly-facing flange remote from the web. Each flange is received by the inner portion of one of the passageways and the corresponding arm is receivable by the corresponding outer portion of the passageway to engage the corresponding side member of the rigid rail.

The rails are interconnected by engaging the side members of respective pairs of rails to the corresponding coupling members by disposing the respective flanges of each coupling member in the inner portions of the corresponding passageways such that the rails are in parallel, spaced relationship. If after the floor mat is assembled by engaging the rails and the coupling members, it is disposed on a flat, horizontal floor, the webs are at the bottommost position in the floor mat to support the weight of the floor mat.

BRIEF DESCRIPTION OF THE DRAWINGS

The preferred embodiments of the present invention are shown in the following drawings, wherein like reference numerals represent like corresponding parts in the several views.

DETAILED DESCRIPTION OF THE PREFERRED EMBODIMENTS

Figure 1:
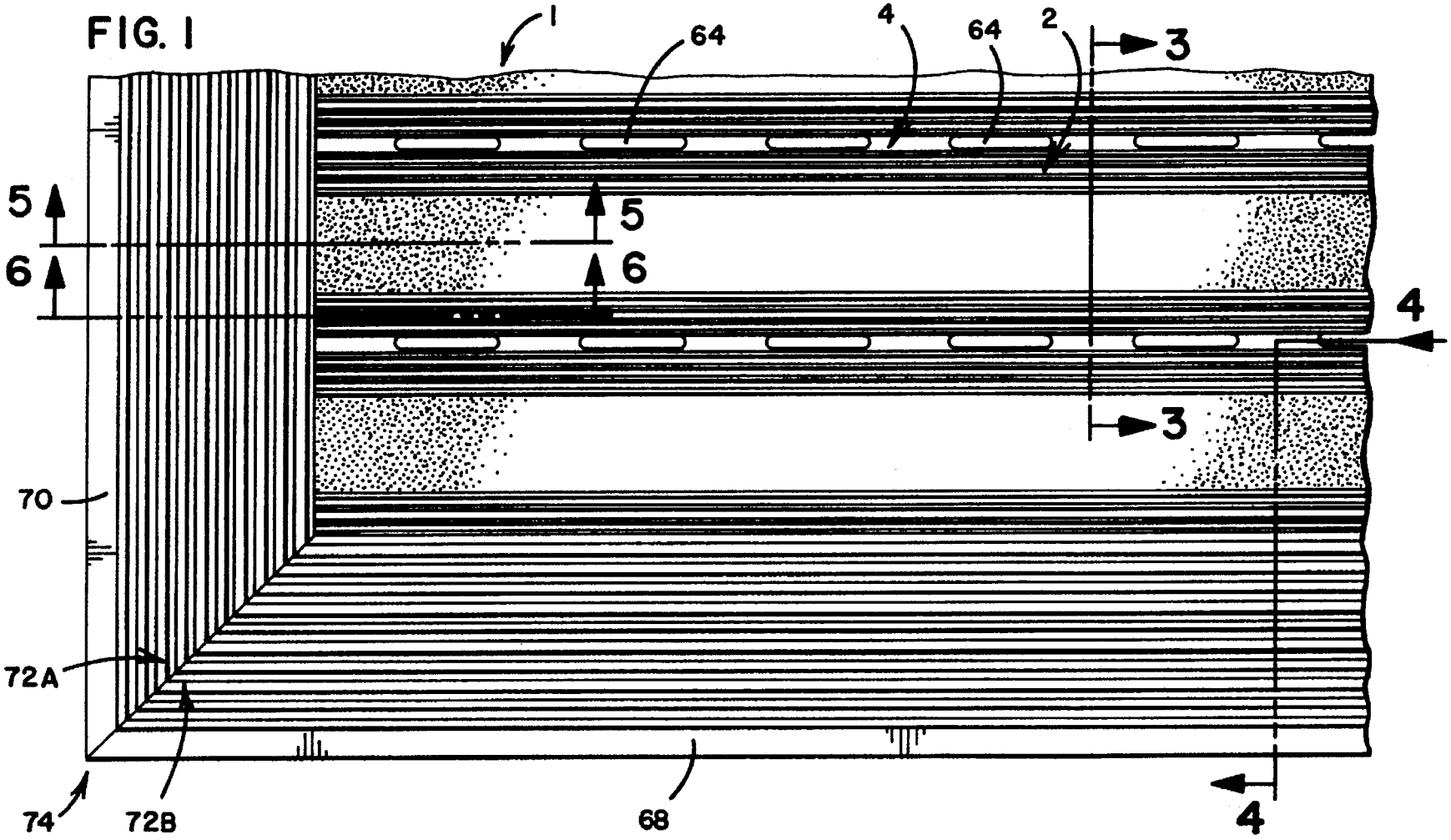
FIG. 1 is a top view of part of a preferred embodiment of a floor mat of the present invention.
Figure 2:
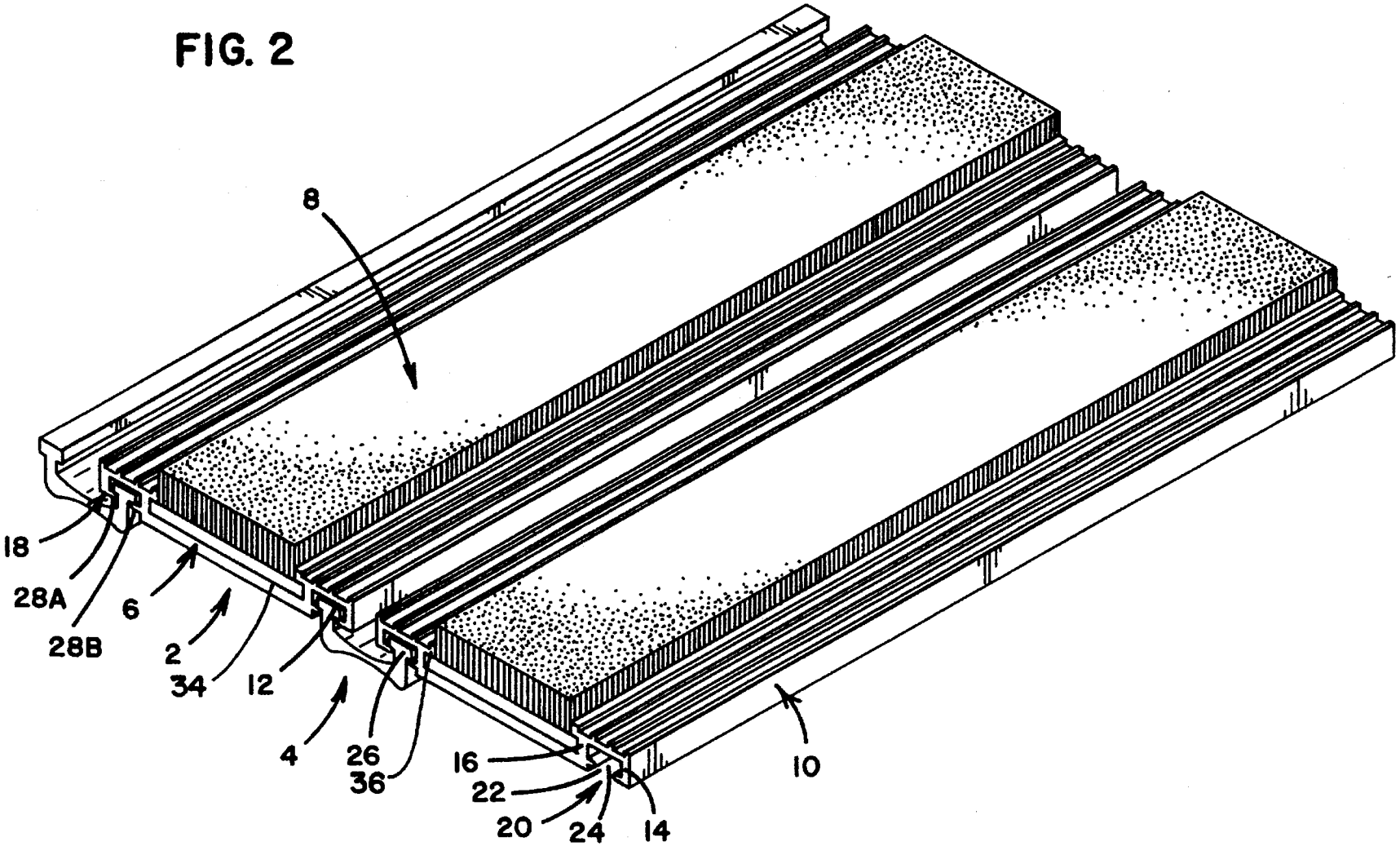
FIG. 2 is an isometric view of part of the preferred embodiment of FIG. 1.

The present invention provides a floor mat that is adapted to be rolled-up and a method of deploying the floor mat on a floor. Referring to FIG. 1 and 2, an illustrative embodiment of a floor mat is shown (a portion of the floor mat is shown in FIG. 1). The present invention has a plurality of substantially rigid, elongated rails 2. The rails 2 are interconnected by coupling members 4 so that the rails are in generally even, parallel, spaced relationship. The coupling members 4 are flexible and resilient so that the floor mat 1 can be rolled up when not deployed, for example, for transportation or storage. When deployed, the floor mat 1 generally lies flat on a horizontal flat floor (not shown in the drawings). Although the floor mat can be deployed on sloping and/or curving surfaces, for reasons of clarity of description, the terms "upward," "downward," "top," "bottom," "horizontal," "vertical," and the like are used for describing orientations and interrelations of parts and elements as if such a floor mat is deployed on a flat horizontal floor. A person skilled in the art will understand that the floor mat and its corresponding elements can assume various orientations when deployed on surfaces other than one that is flat and horizontal.

The rails 2 can be made with a rigid thermoplastic material such as polyvinyl chloride, polystyrene, and the like, or a rigid metal or alloy such as aluminum, brass, stainless steel, and the like. The rigid material is selected to have the proper mechanical integrity for supporting the various parts of the floor mat and the weight of people treading thereon. Preferably, because of the ease of manufacture, low cost and light-weight, the rails are made of extruded aluminum or polyvinyl chloride.

Figure 3:
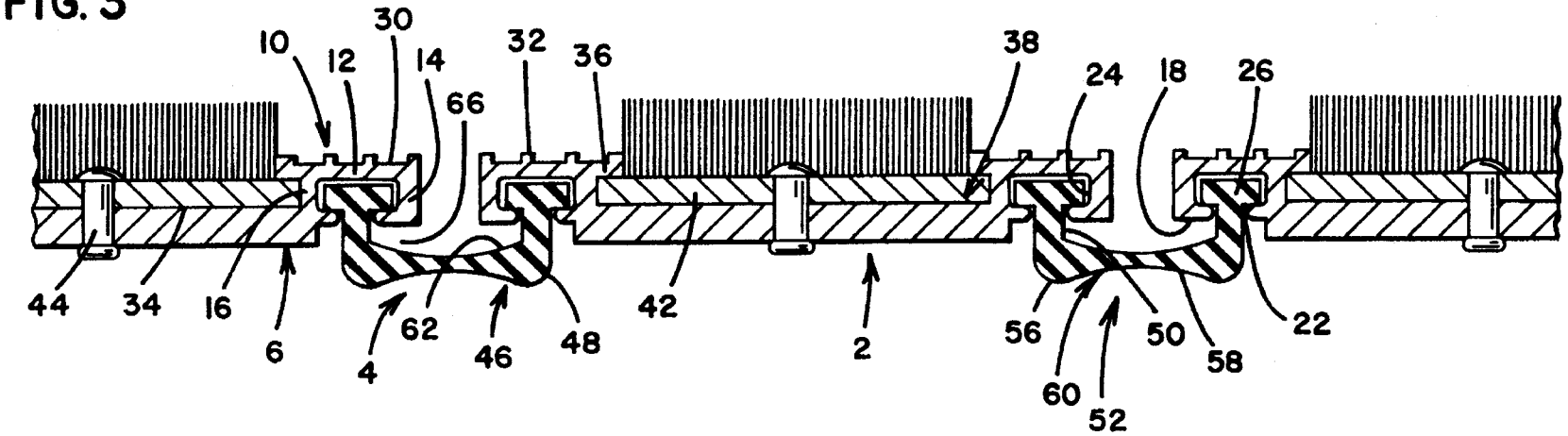
FIG. 3 is a cross-sectional view along the line 3—3 of FIG. 1.
Figure 4:
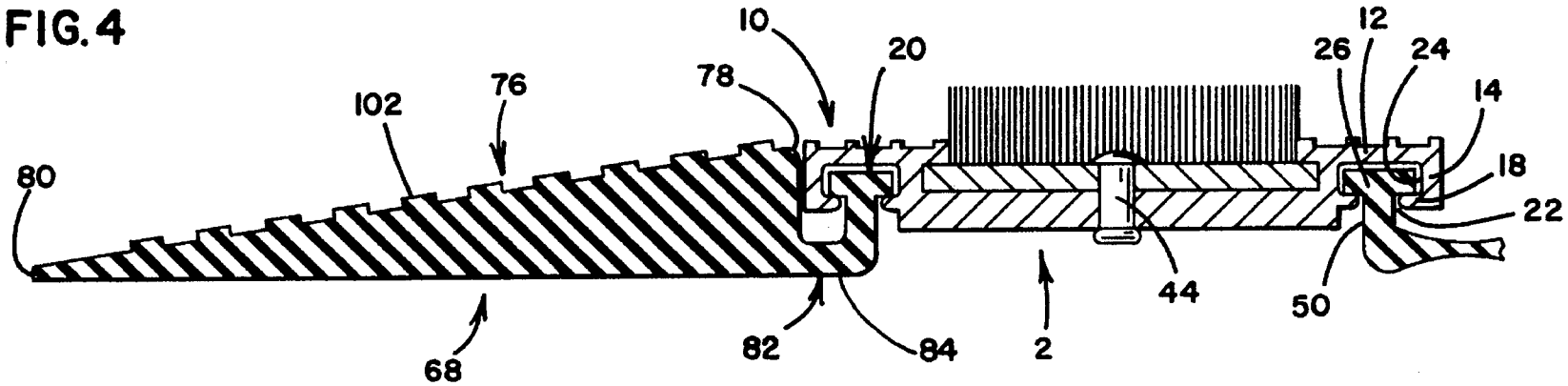
FIG. 4 is a cross-sectional view along the line 4—4 of FIG. 1.

Referring to FIGS. 2–4, each rail 2 has a generally flat base portion 6 supporting a tread surface 8. The base portion 6 is disposed between and unitarily interconnected to side members 10. Each side member 10 has generally flat walls, including an upwardly-facing top wall 12, an inwardly-facing side wall 16, an outwardly-facing side wall 14, and a downwardly-facing bottom wall 18, together defining a passageway (or channel, or groove) 20.

One of the walls, preferably the bottom wall 18, has a longitudinal slot 22 extending through the length of the side member 10. The slot 22 being an outer portion of the passageway 20, which is smaller than the enlarged, inner portion 24 of the passageway defined within the top wall, side walls and the bottom wall. The inner, enlarged portion 24 of the passageway 20 is adapted to receive a flange 26 of a coupling member of the present invention. In effect, the bottom wall 18 form lips 28A, 28B extending toward the slot 22 to retain the flange 26 within the enlarged portion 24 of the passageway 20.

Referring to FIGS. 3–4, preferably, the top surface 30 of each of the side member 10 has longitudinal serration to provide traction for the footwear treading thereon, particularly in the presence of moisture, such as water or snow.

Each inwardly-facing side wall 16 of the side members 10 extends upwardly from the top surface 34 of the base portion 6. At where the inwardly-facing side wall 16 joins the top wall 12, a lip 36 extends inwardly from the side wall 16, such that the base portion 6, the inwardly-facing side walls 16 of the corresponding side members 10 and the inwardly-facing lips 36 define a channel 38 for receiving a strip of pile fabric such as a strip of carpet. The top surface of carpet constitutes part of the tread surface 8 of on the rail 2. Although a pile fabric such as carpet is preferred, it is understood that the pile fabric can be substituted by another material, such as a polymeric or metallic material by one skilled in the art.

Preferably, the top surface 30 of each of the side member 10 has longitudinal serration 32 to provide traction for the footwear in contact therewith, particularly in the presence of moisture, such as water or snow. It is also preferable that the top of the pile fabric strip 40 is slightly above the top surface 30 of the side members 10 of the rail 2 such that when stepped on, the flexible pile of the pile fabric yields slightly so that the top of the strip 40 pile fabric is generally level with the top surface 30 of the side members 10.

Methods of securing a pile fabric, or a polymeric or metallic strip in a channel with a flat bottom are known in the art. Generally, for example, the pile fabric has a pile that is adhered to a backing with an adhesive (not shown in the drawings). The adhesive and the backing 42 of the pile fabric can be adequately rigid such that when the strip 40 of pile fabric is disposed in the channel 38 of a rail 2, the strip is secured in place by the frictional force exerted between the strip and the channel. Preferably, the strip 40 is further secured to the rail by securing arrangements such as rivets 44. Alternatively, other securing arrangements such as a layer of an adhesive (not shown) can be disposed between the backing 42 of the strip 40 and the top surface 34 of the base portion 6 of the rail 2 to secure the strip in the channel 38. Pile fabrics and securing arrangements suitable for such an application are commonly available.

Each pair of adjacent rails 2 are interconnected by a flexible, elongated coupling member (or hinge member) 4 such that the rails are in generally even, parallel, spaced relationship. Each coupling member 4 is disposed between two rails in generally even, parallel, spaced relationship.

The coupling members 4 are preferably made of a material that can be repeatedly flexed, even undergoing temperature changes commonly present in the northern United States without cracking or other signs of damage. The material should be strong enough so that the floor mat can be rolled up for storage.

Preferably, the coupling member 4 is made of a resilient polymeric material that offers traction on rigid structures in contact therewith, such as a floor surface or the passageway of a rail of the present invention. Examples of suitable polymeric materials for making the coupling members of the present invention are polyvinyl chloride, vulcanized natural rubber, or synthetic rubber. More preferable is a thermoplastic rubber that can stay flexible and resists cracking even at a temperature as low as −40° C. An example of such a material is an elastomeric material which comprises polypropylene and ethylenepropylene diene rubber or polypropylene and ethylenepropylene terpolymer. A preferred example is SANTOPRENE® Elastomeric Alloy TPE available from Advanced Elastomers Systems, St. Louis, Mo.

Referring to FIGS. 2–3, each coupling member 4 has a web 46 having a support surface 60 spaced from the rail 2 on the side thereof opposing the floor for contacting the floor. The web 46 further has longitudinal side margins 48. An arm 50 extends from each side margin 48 such that the arms and the web 46 of a coupling member forms a generally U-shape structure 52. Each arm 50 terminates at a flange 26 whose plane is preferably generally parallel to the plane of the web 46. Preferably, to facilitate flexibility, the portion 56 of the web 46 proximate the side margin 48 has a thicker cross section than the portion 58 proximate the midline of the web. More preferably, the surface 60 of the web 46 facing away from the arms is arcuate.

As shown in FIGS. 2–3, the flange 26 of the coupling member 4 is disposed in the enlarged portion 24 of the passageway of the rail 2. The arm extends through the smaller, outer portion 22 of the passageway. The length of the arm 50 and the thickness of the web 46 are selected such that when the floor mat 1 is deployed on a flat, horizontal floor, the web is at the bottommost position in the floor mat. Preferably the web 46 of the coupling member 4 rests on the floor to support the rails 2 off the floor. In this way, the coupling members 4, instead of the rails, sustain the wear and tear resulted from the rubbing actions on the floor. Preferably, the coupling member 4 of the present invention does not have any substantial projections extending from the bottom surface of the web 46 so that the web can be close to the floor. This configuration results in lower maintenance cost as polymeric coupling members 4 are much less expensive than the rails 2 and, therefore, can be regularly replaced.

Preferably, the length of arm 50 is selected such that the arm extends up the passageway 20 so that the flange 26 (i.e. the plane of the flange) faces upward and supports the weight of the rail 2 and the side member 10 does not contact the web 46 in the normal resting position (i.e. when the floor mat is free from externally applied force). In this way, the weight of the rails 2 is transferred to the portion of web directly below the flange. The configuration has the advantage that the force exerting on the arm 50 is vertical and compressive and does not tend to bend and weaken the arm with a shearing force. Preferably, the arm 50 is thicker than the flange 26 (i.e., the vertical dimension of the flange). Alternatively (not shown in the drawings), the arm 50 can be shorter such that the flange 26 does not contact the top wall 12 of the corresponding side member 10. Thus in the resting position, the side member 10 rests on the top surface 62 of web 46 so that the weight of the rail 2 acts thereon. In either instances, the portion of the web 46 proximate the midline thereof does not bear much of the weight of the rail and therefore can be relatively thin to facilitate flexibility.

Preferably, as shown in FIG. 1, the web has regularly-spaced slots (or cut-outs) 64 formed thereon to allow foreign substances, such as particulate material (e.g., sand, dust, dirt) and liquid (e.g., oil, water) to fall therethrough. Such foreign substances, if allowed to accumulate on the web 46, are unsightly. Because the bottom surface 60 of the web is arcuate, foreign substances that fall through the slots 64 can migrate under the webs and will be less visible. Furthermore, because the web 46 is proximate the floor, much light is blocked by the rails 2 and any foreign substance that remains on the top surface 62 of the web will not be as readily visible as in the case where the web is close to the tread surface of the floor mat 1. Further, in the embodiment shown in FIGS. 3–4, because there is a gap 66 between the top surface 62 of the web 46 and the bottom wall 18 of the side member 10, some of the foreign substances can reside in the gap and be shielded from view by the side member. As a result, the configuration of the floor mat can maintain aesthetic appeal for a longer period of time without cleaning. The arcuate configuration of the web 46 also facilitates the draining of water under the web.

Referring again to FIGS. 1 and 4, the floor mat 1 preferably has a generally rectangular configuration with longitudinal 68 and transverse 70 threshold members framing the rails 2 and the coupling members 4. The threshold members 68, 70 can be made of a flexible, resilient polymeric material, preferably the same material of which the coupling members 4 are made. Preferably, each threshold member 68, 70 has mitered ends 72A, 72B so that the end of a longitudinal threshold member 68 and that of a transverse threshold member 70 can be fitted together to form a corner 74. Each threshold member 68, 70 is generally tapered to have an inclined upper surface that slopes downwardly from the inner edge 78 (i.e., an edge that faces the rails) to the free, outer edge 80 (i.e., the edge that faces away from the rails).

Referring to FIG. 4, each longitudinal threshold member 68 has a longitudinal coupling member 82 with a web 84 that extends from the inner edge 78 in a direction toward the rail (i.e., opposite the outer edge 80). An arm 86 with a flange 88 is unitarily connected to the web 84 in a manner similar to that of the coupling member 4 that interconnects rails 2. The coupling member 82 is positioned on the inner edge 78 of the threshold member 68 such that the flange 88 can be disposed in a passageway 20 of a rail 2 to support the rail in a similar manner as does the coupling member 4 interconnecting the rails. When the threshold member 68 is coupled to an adjacent rail 2, its inner edge 78 abuts the outwardly-facing side wall 14 of the rail such that its top surface 76 proximate the rail 2 is generally flush with the top surface 30 of the side member 10 of the rail.

Figure 5:
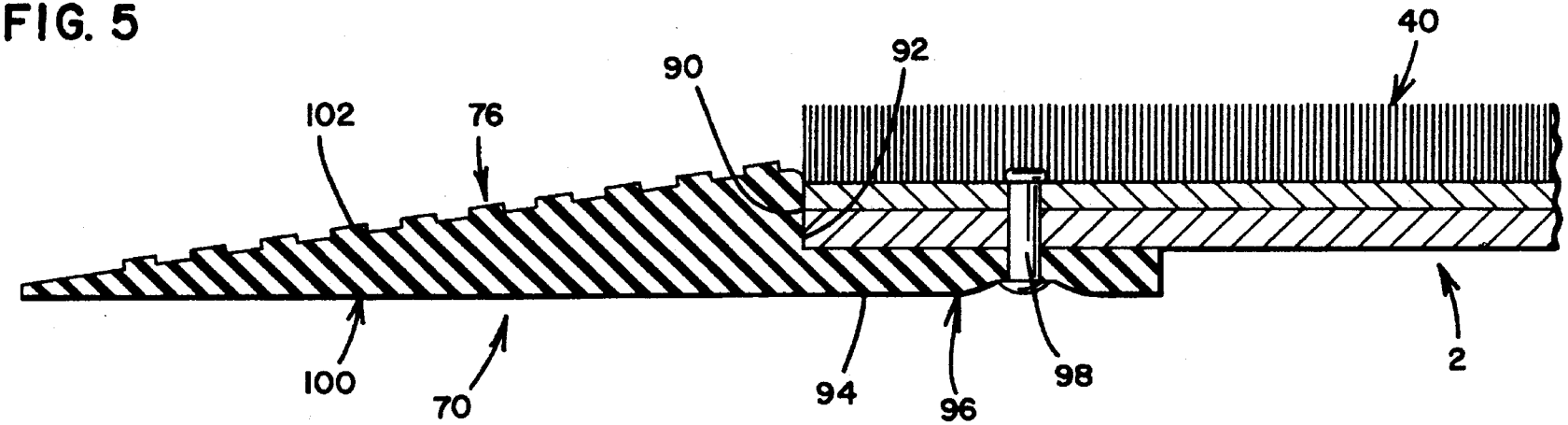
FIG. 5 is a cross-sectional view along the line 5—5 of FIG. 1.
Figure 6:
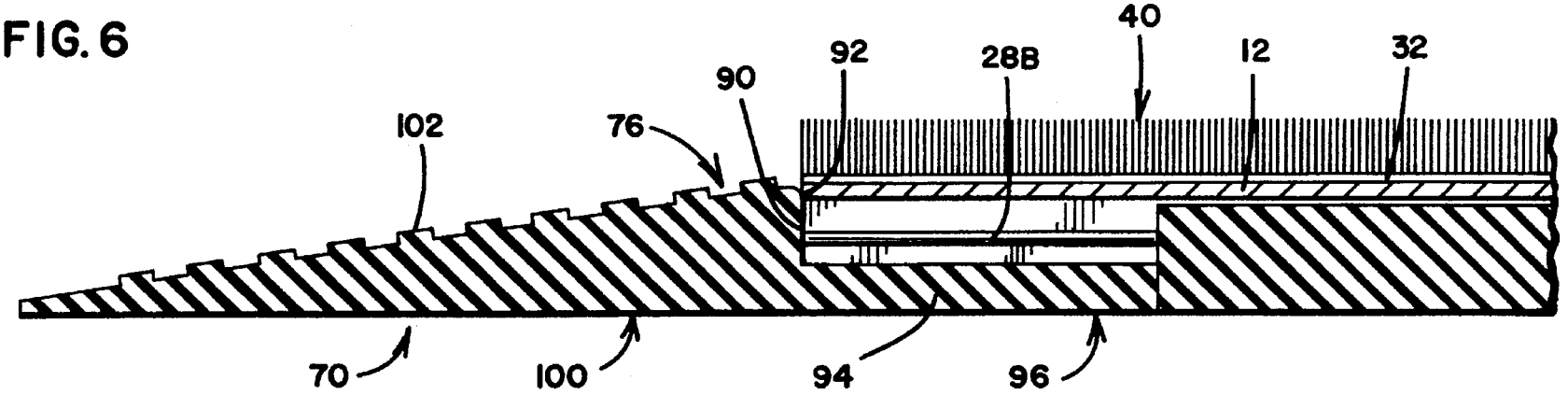
FIG. 6 is a cross-sectional view along the line 6—6 of FIG. 1.

Referring to FIG. 1 and FIGS. 5–6, the transverse threshold member 70 has an inner edge 90 that abuts the ends 92 of the rails 2. Each transverse threshold member 70 contacts a plurality of rails 2 in generally perpendicular relationship. A continuous leg 94 extends from the bottom portion 96 of the transverse threshold member in a direction toward the rails and is disposed under the rails to support the weight thereof. Each of the rails 2, and if preferred, the strips 40 of pile fabric on the rails as well, can be secured to the transverse threshold member 70 by a securing arrangement such as a rivet 98. Because of the resilient nature of the threshold member 70, the material of the leg compresses to allow the bottom surface 100 of the threshold member to contact the floor (not shown) even at a location proximate the rivet 98. Referring to FIG. 6, which show a cross section of the mat along the passageway 20 of a rail 2, the continuous leg 94 of a transverse threshold member 70 extends for a distance appropriate for receiving a rivet, for example, about 2.5 cm, under a rail. The leg 94 can extend to abut a coupling member 4 of the present invention. Preferably, the threshold members 68, 70 each has serration 102 on the upper surface to increase traction.

The floor mat 1 of the present invention is assembled by disposing the flange 26 of a coupling member 4 in the inner portion 24 of the passageway 20 of a rail by sliding the arm 50 and flange of the coupling member along the passageway until the entire length of the flange of the coupling member is slidably disposed in the corresponding passageway of the rail. The process is repeated to interconnect rails 2 with coupling members 4 until a structure of a desired size is achieved. Alternatively, the coupling members 4 and the rails 2 can be coupled together by placing them side by side and the flange 26 of the coupling member can be pushed into the passageway 20 through the slot (or outer portion of the passage) 22, preferably with a tool, such as a screw driver with a flat blade. In this way, the flange 26 engages the passageway 20 of the side member 10 of the rail 2.

If desired, threshold members 68, 70 of suitable dimensions are connected to the rails. A longitudinal threshold member 68 is connected to the rail 2 by disposing the arm 50 and flange 26 into the passageway 20 of a rail in a manner similar to that for interconnecting rails. A transverse threshold member 70 is connected to the rails by positioning in abutment with the ends of the rails with the leg 94 extending under the rails 2 and in a mitered fit with the longitudinal threshold member 68 and riveting the continuous leg 94 to the rails 2. The coupling members 4 can be secured to the rails 2 by removable securing arrangements such as set screws. For example, A set screw (not shown in the drawings) with a outer diameter slightly larger than the width of the slot 22 of the bottom wall 18 of the rail and a length shorter than the combined dimension of the web 46 and the arm 50 of a coupling member 4 can be used to screw from the bottom surface 60 of the web through the web 46 into the slot to secure the coupling member to the bottom wall of the rail. To replace a worn-out coupling member 4, the set screw can be removed from the rail and from the coupling member and the couplings member can be disengaged from the rail 2 by sliding the flange 26 out of the passageway 20.

The floor mat 1 of the present invention can be disposed indoor or outdoor, particularly adjacent to an entrance of a building. When the floor mat is to be removed, for example, for maintenance or storage, it can be rolled up into a bundle. The floor mat can also be disposed in a recessed space on a floor wherein the recessed space has a vertical dimension approximate equal to that of the floor mat. In such a case, the floor mat can be used without threshold members.

The present invention has been described in the foregoing specification. The embodiments are presented for illustrative purpose and are not to be interpreted as unduly limiting the scope of the invention. It is to be understood that modifications and alterations of the invention, especially in size and shape, will be apparent to those skilled in the art without departing from the spirit and scope of the invention. For example, the coupling member 82 of a longitudinal threshold member 68 can extend from the inner edge 78 at a point slightly above the bottom surface of the threshold member, or the webs 46 of the coupling members 4 interconnecting rails can have projections directly under the arms 50 to further increase the thickness of the portion of the coupling members most often subjected to wear and tear. Furthermore, the flanges can be made to face in a non-upwardly-directing fashion and yet the webs still support the weight of the rails, or the bottom portions of the coupling member be made to be non-U-shaped and yet the flanges still support the weight of the rails.

What is claimed is:

1. A floor mat adapted to be rolled up, comprising:

a plurality of rigid, elongated rails disposed generally parallel to each other in spaced relationship, each of the rails including a base portion supporting a tread surface and a pair of parallel side members connected to the lateral sides of the base portion, each of the side members defining a passageway for receiving an arrangement of a coupling member;

a plurality of flexible, resilient, elongated coupling members each interconnecting a pair of rails in parallel, spaced relationship, each of the coupling members including a web with longitudinal side margins, an arrangement connected to each of the side margins and being received by said passageway to engage the corresponding side member of the rail, the web being at the bottommost position in the floor mat, wherein the cross section of each of the webs has a thicker dimension proximate to the side margins than distal to the side margins.

2. The floor mat according to claim 1 wherein each of the side members define a passageway having an enlarge inner portion and an outer portion which is open at the side member and facing downwardly, the coupling member further having an arm extending upwardly from the web at each side margin thereof and wherein an upwardly-facing flange is connected to the arm remote from the web, each flange being received by the inner portion of one of the passageways and the arm being received by the outer portion of the passageway to engage the corresponding side member of the rigid rail.

3. The floor mat according to claim 2 wherein, when the floor mat is deployed on a horizontal floor, each of the flanges contacts a respective downwardly-facing wall of the corresponding side member of the corresponding rail to support the rail.

4. The floor mat according to claim 2 wherein, when the floor mat is deployed on a horizontal floor, each side member of the rail presses downwardly on a portion of a respective web adjacent to but not directly under the arm of the corresponding coupling member.

5. The floor mat according to claim 2 wherein the arm has a larger thickness than the flange.

6. The floor mat according to claim 1 further comprising piled fabric strips and wherein each of the rails has a channel opening on the tread surface thereof for receiving one of the piled fabric strip.

7. The floor mat according to claim 1 further comprising at least one threshold member connected to at least one rail, the threshold member having a surface sloping downwardly away from the rail.

8. The floor mat according to claim 7 wherein the threshold member has a web connected to an arrangement for engaging the passageway of one of the rails, wherein the web of the threshold member is at the bottommost position in the floor mat.

9. The floor mat according to claim 1 wherein when the floor mat is deployed on a floor, each of the webs contacts the floor and supports the weight of the rail in contact therewith.

10. The floor mat according to claim 1 wherein the web has longitudinally spaced slots formed therein.

11. A floor mat deployable on a floor and adapted to be rolled up when not deployed, comprising:

a plurality of rigid elongated rails disposed generally parallel to each other in spaced relationship, each of the rails including a generally flat portion and a pair of parallel side members, wherein the flat portion is disposed between and interconnects the side members, each of the side members having walls including a top and two side walls and a bottom wall, the bottom wall defining a longitudinal slot therein and being proximate to the floor;

a plurality of flexible, elongated coupling members each interconnecting a pair of rails in parallel, spaced relationship, each of the coupling members including a web with longitudinal side margins, an arm extending upwardly from the web at each side margin thereof through the slot of the bottom wall, and an upwardly-facing flange connected to the arm remote from the web, each flange having a width wider than that of the slot and contacting the top wall to support the weight of the rail, wherein the cross section of each of the webs has a thicker dimension proximate to the side margins than distal to the side margins.

12. A floor mat adapted to be rolled up, comprising:

a plurality of rigid elongated rails disposed generally parallel to each other in spaced relationship, each of the rails including a base portion supporting a tread surface of the mat and a pair of parallel side members connected to the base portion, each of the side members defining a longitudinal passageway, wherein each of the rails has a channel opening on the tread surface thereof for receiving a pile fabric strip;

a plurality of flexible, elongated, generally U-shaped coupling members each interconnecting a pair of rails in parallel, spaced relationship, each of the coupling members including a web with longitudinal side margins, and having a top portion and a bottom portion, the top portion of the coupling member having flanges, each flange being received by the passageway to engage one of the rails, the bottom portion of the coupling member contacting the floor to support the corresponding rail, wherein the cross section of each of the webs has a thicker dimension proximate to the side margins than distal to the side margin; and a plurality of piled fabric strips each disposed in a respective channel opening on the tread surface of a rail.

13. The floor mat according to claim 12 wherein the flanges face upwardly.

14. A floor mat adapted to be rolled up, comprising:

a plurality of rigid elongated rails disposed generally parallel to each other in spaced relationship, each of the rails including a base portion supporting a tread surface of the mat and a pair of parallel side members laterally connected to the base portion, each of the side members defining a passageway having an enlarged inner portion and an outer portion which is open at the side member and facing downwardly, wherein each of the rails has a channel opening on the tread surface thereof for receiving a pile fabric strip;

a plurality of flexible, elongated coupling members each interconnecting a pair of rails in parallel, spaced relationship, each of the coupling members including a generally flat web with longitudinal side margins, an arm extending upwardly from the web at each side margin thereof, and an upwardly-facing flange connected to the arm remote from the web, each flange being received by the inner portion of the passageway and the arm being received by the outer portion of the passageway to engage one of the rails, the flange contacts a downwardly-facing wall of one of the side members of the rail to support the rail, each of the webs being at the bottommost position in the floor mat and having longitudinally spaced slots formed thereon, wherein the cross section of each of the webs has a thicker dimension proximate to the side margins than distal to the side margins; and a plurality of piled fabric strips each disposed in a respective channel opening on the tread surface of a rail.

* * * * *